United States Patent [19]

Suzuki et al.

[11] 4,446,584

[45] May 8, 1984

[54] HEATED TOILET SEAT

[75] Inventors: Koichi Suzuki, Chiryu; Mikio Yoshihara, Kariya; Shinji Kawai; Katsuhiro Mori, both of Toyota, all of Japan

[73] Assignee: Aisin Seiki Kabushiki Kaisha, Kariya, Japan

[21] Appl. No.: 435,465

[22] Filed: Oct. 20, 1982

[30] Foreign Application Priority Data

| | | | |
|---|---|---|---|
| Oct. 22, 1981 | [JP] | Japan | 56-157780[U] |
| Dec. 21, 1981 | [JP] | Japan | 56-190490[U] |
| Dec. 21, 1981 | [JP] | Japan | 56-190491[U] |
| Dec. 21, 1981 | [JP] | Japan | 56-190492[U] |
| Dec. 21, 1981 | [JP] | Japan | 56-190493[U] |
| Dec. 21, 1981 | [JP] | Japan | 56-190494[U] |

[51] Int. Cl.[3] ..... A47K 13/30

[52] U.S. Cl. ..... 4/237; 4/DIG. 6; 339/4; 174/DIG. 9

[58] Field of Search ..... 4/300, 447, 661, 234–242, 4/DIG. 6; 174/DIG. 9; 339/4

[56] References Cited

U.S. PATENT DOCUMENTS

| | | | |
|---|---|---|---|
| 2,550,021 | 4/1951 | Rappl | 174/DIG. 9 |
| 2,665,414 | 1/1954 | Hubacker | 339/4 |
| 3,034,226 | 5/1962 | Conlee | 339/4 |
| 4,123,807 | 11/1978 | Oguma et al. . | |

FOREIGN PATENT DOCUMENTS

| | | | |
|---|---|---|---|
| 489941 | 1/1953 | Canada | 339/4 |
| 1418846 | 10/1965 | France | 174/DIG. 9 |
| 547989 | 9/1956 | Italy | 4/237 |

*Primary Examiner*—Stephen Marcus
*Assistant Examiner*—Kenneth S. Putnam
*Attorney, Agent, or Firm*—Finnegan, Henderson, Farabow, Garrett & Dunner

[57] ABSTRACT

An apparatus for accommodating an electrical cord in a heated toilet seat having a toilet seat body and a base cover pivotally connected to each other, wherein an electrical cord adapted for electrical connection between a heater mounted within the toilet seat body and a controller therefore is secured at one by a grommet provided on the base cover and at the other end by a cord fastener in the toilet seat body. Sufficient cord slack is provided in the toilet seat body so that the cord may be retracted or extended during the pivoting of the toilet seat body. The cord slack is in the shape of a loop, and a guide stopper is positioned within the loop to guide the cord during extension and retraction and limit the maximum extension of the cord.

8 Claims, 4 Drawing Figures

HEATED TOILET SEAT

BACKGROUND OF THE INVENTION

1. Field of the Invention

This invention relates to a heated toilet seat and, more particularly, to a heated toilet seat provided with unique means for accommodating an electrical cord.

2. Description of the Prior Art

In a heated toilet seat having a toilet seat body fitted with heating wires as heating elements and a base cover fitted with a controller for controlling the heaing elements, the electrical cord connecting the toilet seat body with the base cover is usually arranged in an exposed condition on the outside of the toilet seat housing. This not only causes a number of inconveniences related to mounting, extension, retraction and handling of the cord, but also detracts from the overall appearance of the toilet seat.

SUMMARY OF THE INVENTION

Accordingly, an object of the present invention is to provide an apparatus for accommodating an electrical cord in a heated toilet seat free of the inconveniences encountered in the prior art.

Another object of the present invention is to provide an apparatus for accommodating an electrical cord in a heated toilet seat in which the electrical cord can be accommodated in a compact manner and both extended and retracted smoothly to prevent damage to the cord.

Another object of the present invention is to provide an apparatus for accommodating an electrical cord in a heated toilet seat in which the electrical cord can be accommodated within the toilet seat without being pinched, bent or stretched excessively when the toilet seat is raised and lowered, and without allowing water and contaminants to pass through an opening provided for the electrical cord.

According to the present invention, these and other objects are attained by providing an electrical cord accommodating apparatus in a heated toilet seat having a hollow interior portion adapted to accommodate the electrical cord which is mounted in position through the opposing or abutting portions of a toilet seat body and a base cover. When the toilet seat is in the lowered, or closed, attitude, the electrical cord develops slack to permit the extension of the cord when the seat is raised, or opened. The slack portion of the cord is formed as a loop and accommodated within the hollow interior portion of the toilet seat body. A guide stopper is provided within this hollow interior portion and positioned within said loop to guide the cord smoothly during the extension and retraction thereof. The slack in the cord may thus be taken up with facility when the seat is lowered and payed out smoothly when the seat is raised without causing damage to the cord. More specifically, the toilet seat body is provided with a space for accommodating the extending or retracting portion of the electrical cord, and the cord is mounted in position through the opposing or abutting surfaces of the toilet seat body and the base cover. A slide bushing is disposed in an opening of the toilet seat body for passage of the electrical cord in order to reduce the sliding resistance acting upon the cord, thereby preventing the cord from being pinched between the base cover and the toilet seat body. The electrical cord is fastened at one end by a grommet mounted on a base cover surface portion adjacent to the toilet seat body, with the slack portion of the cord being taken up in the toilet seat body to conceal the cord. Thus the cord is accommodated with facility, operates smoothly and does not detract from the external appearance of the toilet seat. In addition, since the cord passage leading to the inside of the base cover is rendered liquid-tight by the grommet, there is no risk of intrusion of liquids and contaminants through the opening provided for the cord. A piece of tape or fabric or the like, having an excellent sliding property, is affixed to the heater so that the extension and retraction of the slack cord portion occurs through the medium of the tape piece, without the cord contacting the heater directly. Thus, smooth operation is assured and there is no risk that the cord will be pinched between the toilet seat body and the base cover when the toilet seat is raised and lowered. In another aspect of the present invention, a slide sheet having the guide stopper and a curved wall is provided in the electrical cord accommodating portion of the toilet seat body so that the cord may be extended or retracted smoothly and accommodated in a compact manner without damage to the cord.

Other features and advantages of the invention will be apparent from the following description taken in conjunction with the accompanying drawings in which like reference characters designate the same or similar parts through the figures thereof.

DESCRIPTION OF THE PREFERRED EMBODIMENT

Figure 1:
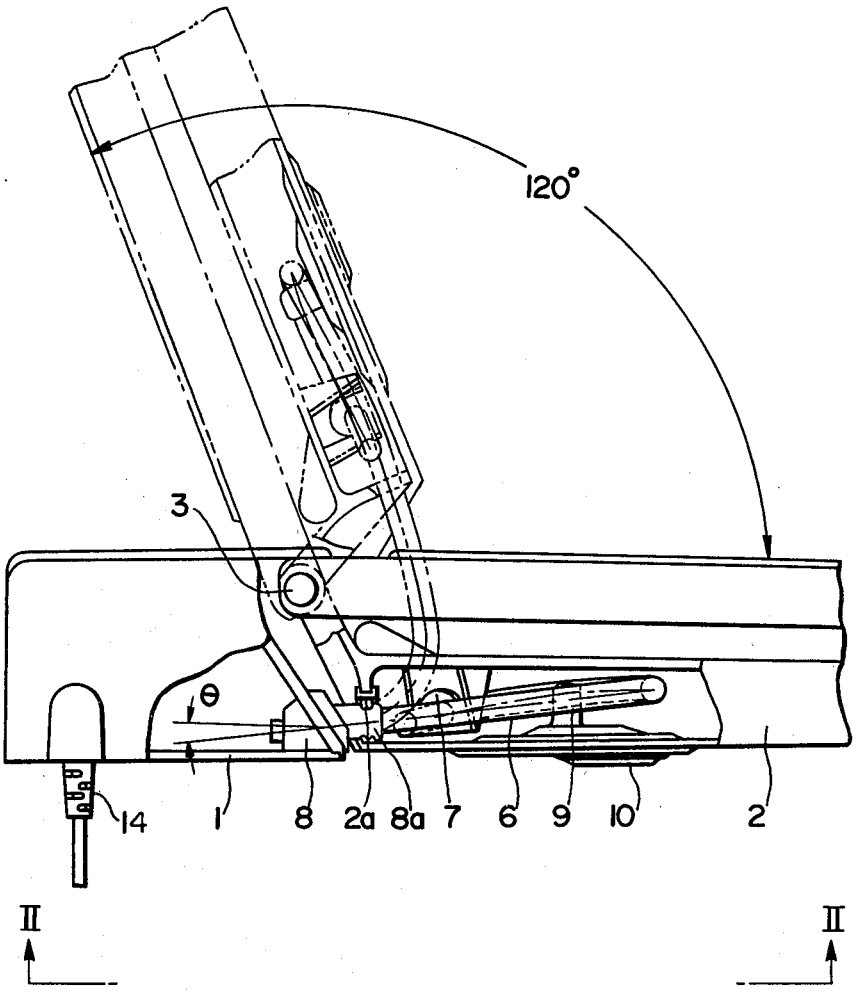
FIG. 1 is a side elevation showing a first embodiment of a toilet seat according to the present invention, shown with a portion thereof cut away and with the toilet seat body being shown in phantom lines in a raised attitude.
Figure 2:
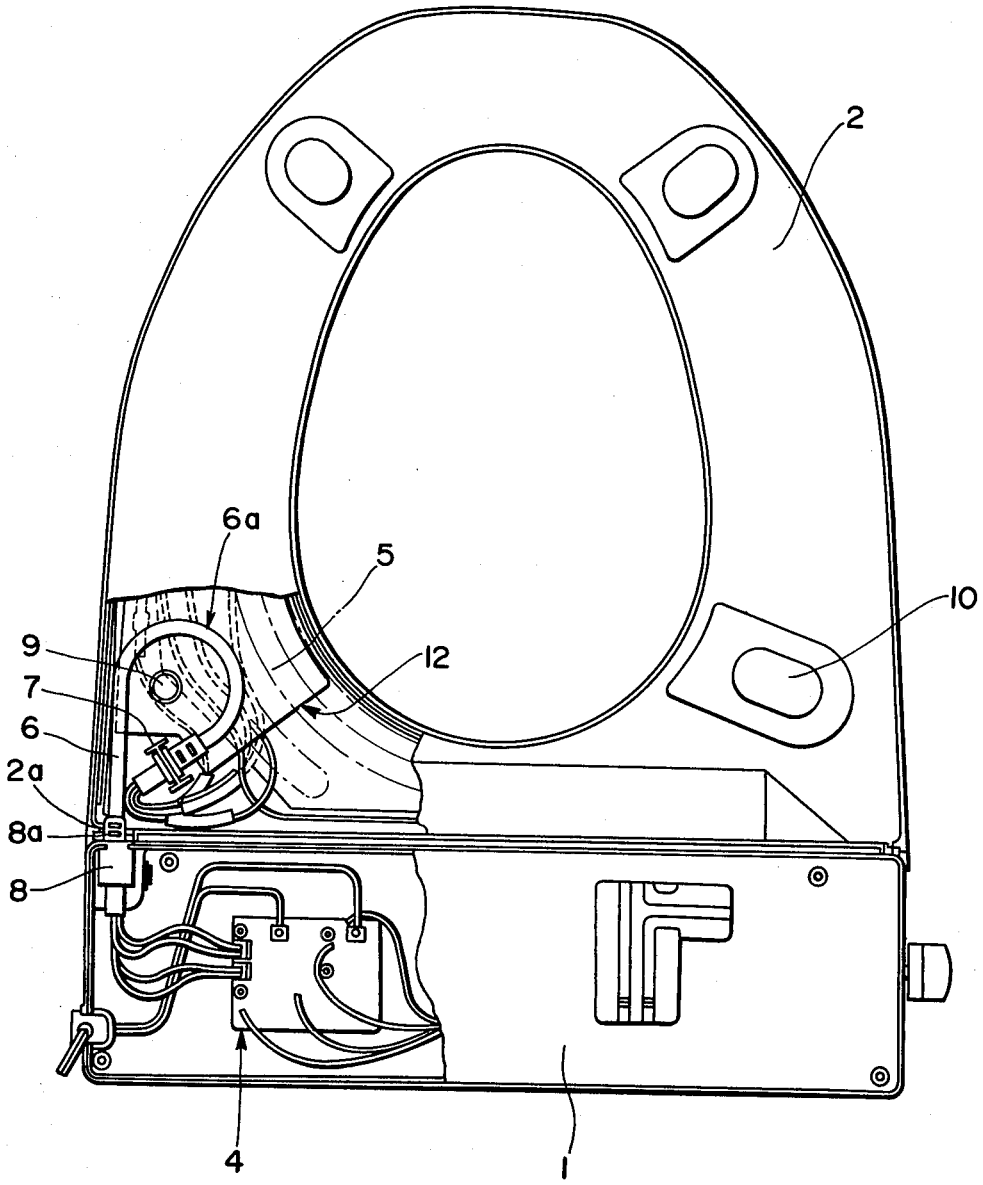
FIG. 2 is a top plan view of the toilet seat shown in FIG. 1, with a portion cut away.

Referring to FIGS. 1 and 2, a base cover 1 is connected to a toilet seat main body 2 by left and right hinge members 3, only one of which is shown in the drawings. The toilet seat body 2 is pivotable via the hinge members 3 through an angle of about 120 degrees relative to the base cover 1 as indicated by the phantom lines in FIG. 1. Mounted within the base cover 1 is a controller 4 electrically connected by an electrical cord 6 to a heater 5 for controlling the heater, the latter being provided within the toilet seat body 2. When the toilet seat body 2 is in the lowered, or closed, state, the electrical cord 6 has a slack portion 6*a* of a length sufficient to permit extension of the cord when the toilet seat body is raised by being pivoted about the hinge members 3. The toilet seat body 2 has a hollow interior portion within which the end of the cord 6 connected to the heater 5 is secured by a cord fastener 7. The other end of the electical cord 6, from which conductors extend to the controller 4, is tightly fastened within a grommet 8 which fits liquid-tight into a hole provided in the base cover 1 at a location facing the rear of the toilet seat body 2 when the latter is in the lowered attitude. The hole and grommet permit the electrical cord 6 to pass through the base cover 1 to effect the connection from the heater 5 to the controller 4 while assuring that water and other contaminants will not invade the interior of the base cover. The rear portion of the toilet seat body 2 has an opening 2a provided at a position corresponding to that of the grommet 8 when the toilet seat body is in the closed attitude. The grommet 8 has a reduced diameter portion 8a for passing through the opening 2a at the rear portion of the toilet seat body 2 when the latter is closed. This assures that the electrical cord will not be nipped or cut by the edge of the hole 2a when the toilet seat body 2 is raised and lowered by being pivoted about the hinges 3. This will be described in further detail hereinbelow. A guide stopper 9 is provided on a bottom plate constituting the toilet seat body 2. The guide stopper 9, disposed within a loop formed by the electrical cord 6, not only guides the electrical cord 6 during extension and retraction when the toilet seat body is raised and lowered, but also limits the maximum extension of the cord when the seat is raised, thereby assuring smooth cord operation and preventing cord damage.

Reference numeral 10 in the drawing designates plural cushioning elements attached to the reverse side of the toilet seat body 2, and reference numeral 14 designates a socket for connection to a power source.

When the toilet seat body 2 is raised to the attitude shown by the phantom lines by pivoting it in the counter-clockwise direction in FIG. 2, the electrical cord 6, one end of which is held secure in the grommet 8, is extended in linear fashion as it slides through the opening 2a while being guided by the guide stopper 9. As the electrical cord 6 is extended, the slack portion 6a thereof is shortened correspondingly. As shown in FIG. 1, the guide stopper 9 engages the inner side of the cord 6 and decides how far the cord will be extended. When the toilet seat body 2 is returned to its original horizontal attitude, the cord 6 is restored to its slackened and accommodated state shown by the solid lines in FIG. 1.

Reference numeral 12 in FIG. 2 designates a heat-resistant cloth or fabric fixedly positioned between the heater 5 and the electrical cord 6 for protecting the cord 6 and for assuring that the cord will slide smoothly. The cloth 12 may be replaced by a tape made of a suitable material having an excellent sliding property, resistance to friction and durability, such as surface-treated aluminum foil or a Teflonized fabric. Placed on the heater 5 within the toilet seat body 2, the cloth or tape 12 is of sufficient size to cover the range of cord extension and retraction, and is effective to permit smooth extension and retraction of the slack portion 6a of the cord.

The small diameter portion 8a of the grommet 8 is so arranged that, when the toilet seat body 2 is in the lowered or closed attitude, said small diameter portion 8a will protrude through the opening 2a in the toilet seat body 2 with an upward tilt $\theta$ on the order to preferably 5 to 15 degrees. Such tilt is effective to reduce bending or sliding friction between the electrical cord 6 and the opening 2a during raising and lowering of the toilet seat body 2, and to prevent the electrical cord 6 from slipping into a gap between the toilet seat body and the base cover 1 and being pinched. Preferably, a slide bushing is disposed in the opening 2a for sheathing the inner edge of the opening and assuring smooth sliding of the electrical cord 2. The slide bushing is also effective for preventing the cord 6 from slipping into the gap between the base cover 1 and the toilet seat body 2 and being pinched during the raising and lowering of the toilet seat.

Figure 3:
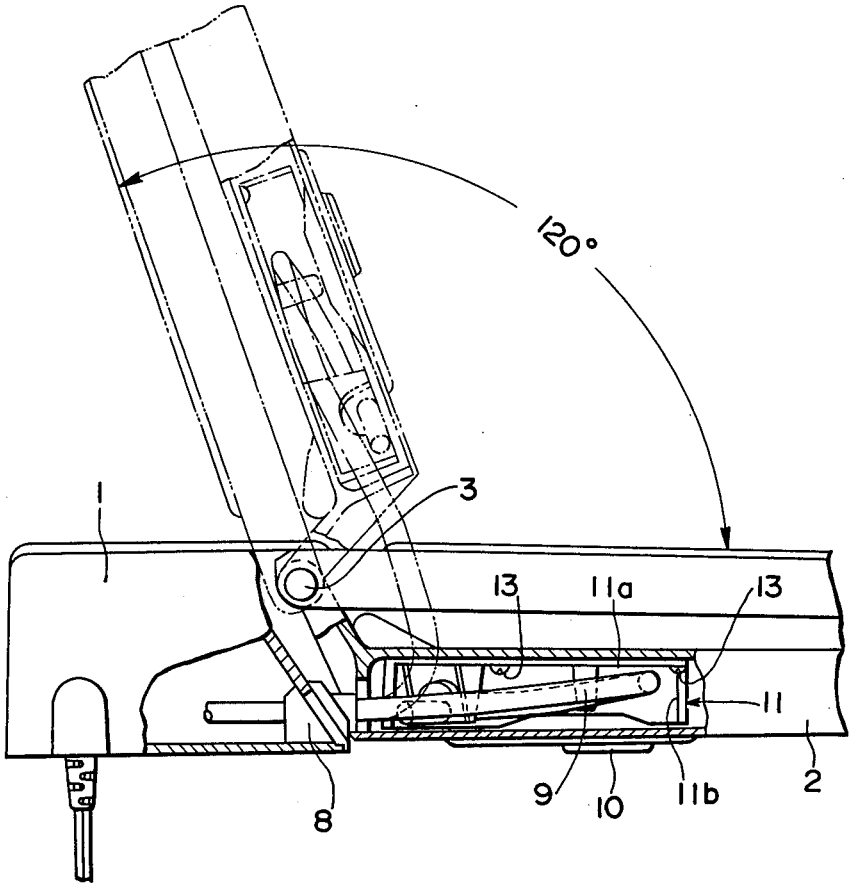
FIG. 3 is a side elevation similar to FIG. 1 and showing a second embodiment of the present invention.
Figure 4:
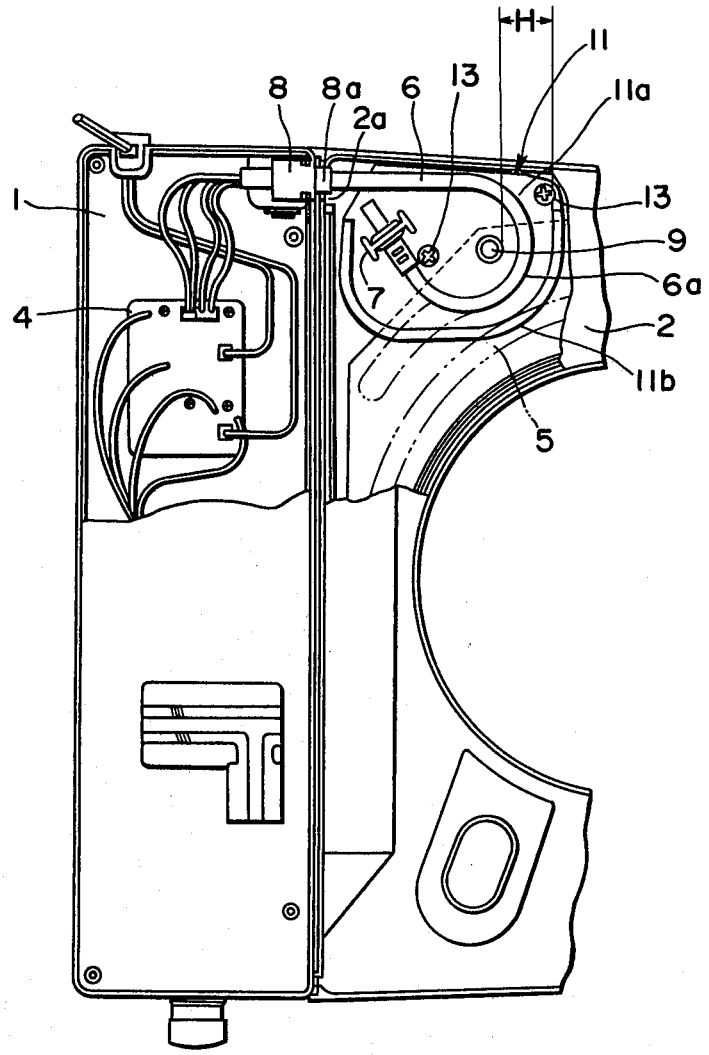
FIG. 4 is a top plan view similar to FIG. 2 and showing the embodiment of FIG. 3, with the toilet seat body being removed.

Reference will now be had to FIGS. 3 and 4 to describe a second embodiment of the present invention. As in the first embodiment, the base cover 1 is connected to the toilet seat main body 2 by left and right hinge members 3, only one of which is shown in the drawings. The toilet seat body 2 is pivotable via the hinge members 3 through an angle of about 120 degrees relative to the base cover 1 as indicated by the phantom lines in FIG. 3. The controller 4 mounted within the base cover 1 is electrically connected by the electrical cord 6 to the heater 5 for controlling the heater, which is provided within the toilet seat body 2. When the toilet seat body 2 is in the lowered state, the electrical cord 6 develops the slack portion 6a of a length sufficient to permit extension of the cord when the toilet seat body is raised by being pivoted about the hinge members 3. The end of the cord 6 connected to the heater 5 is secured within the hollow interior portion of the toilet seat body 2 by the cord fastener 7. The other end of the electric cord 6, from which conductors extend to the controller 4, is tightly fastened within the grommet 8 which fits liquid-tight into the hole provided in the base cover 1. The hole and grommet permit the electrical cord 6 to pass through the base cover 1 to effect the connection from the heater 5 to the controller 4 while assuring that water and other contaminants will not invade the interior of the base cover. The rear portion of the toilet seat body 2 has the opening 2a provided at a position corresponding to that of the grommet 8 when the toilet seat body is in the lowered attitude. The reduced diameter portion 8a of the grommet 8 passes through the opening 2a at the rear portion of the toilet seat body 2 when the latter is closed. According to this embodiment of the invention, the guide stopper 9 is provided on a slide plate 11. The slide plate 11 is made of a insulative, non-metallic material such as synthetic resin having an excellent sliding property and is constituted by a seat plate portion 11a and a curved upright wall portion 11b. The cord guide stopper 9 is formed integrally with the seat plate portion 11. The cushioning element is designated at numeral 10.

The space delimited by the curved wall portion 11b is just large enough to accommodate the electrical cord 6. The guide stopper 9 is spaced by a distance H from the curved wall portion 11b so that extension and retraction of the cord 6 is not obstructed by the guide stopper. The slide plate 11 is secured within the hollow interior portion of the toilet seat body 2 via screws 13 passed through the seat plate portion 11a of the slide sheet 11.

When the toilet seat body 2 is raised to the attitude shown by the phantom lines by pivoting it in the counter-clockwise direction in FIG. 3, the electrical cord 2, one end of which is held secure in the grommet 8, is extended as it slides through the opening 2a while being guided by the guide stopper 9. As the electrical cord 6 is extended, the slack portion 6a thereof is shortened correspondingly. As shown in FIG. 3, the guide stopper 9 engages the inner side of the cord 6 and decides how far the cord will be extended. When the toilet seat body 2 is returned to its original horizontal attitude, the cord 6 is restored to its slackened state and accomodated within the curved wall portion 11b, as indicated by the solid lines in FIG. 4.

The electrical cord 6 may be extended or retracted smoothly since it slides against the seat plate portion 11a of the slide sheet 11. When the cord 6 has been extended fully, the guide stopper 9 stops the cord 9 to prevent the application of an excessive force and to prevent cord damage while assuring smooth cord operation. When the electrical cord 6 is retracted by closing the toilet seat body 2, the cord is guided by the curved wall portion 11*b* without deviating towards the outside and can be accurately accommodated on the slide plate 11 in the space delimited by the wall portion 11*b*.

In the present embodiment, the guide stopper 9 may be formed integrally with the slide sheet 11 or may be fabricated as a separate member and connected thereto by any suitable connecting means.

As many apparently widely different embodiments of the present invention may be made without departing from the spirit and scope thereof, it is to be understood that the invention is not limited to the specific embodiments thereof shown in the drawings except as defined in the appended claims.

What we claim is:

1. An apparatus for accommodating an electrical cord in a heated toilet seat which comprises a toilet seat body having a hollow interior portion and a heater, a base cover having control means for controlling the heater, and an electrical cord for electrically interconnecting the heater and the control means, said toilet seat body being connected to said base cover for pivoting through a predetermined angle, wherein said base cover is provided with a hole, a grommet fitted within said hole, and one end of said electrical cord is tightly secured within said grommet, and wherein the other end of said electrical cord is fixed within the hollow interior portion of said toilet seat body and has a slack portion in the shape of a loop accommodated within said hollow interior portion, said electrical cord extending from said hollow interior portion to take up the slack when said toilet seat body is pivoted in an opening direction, said electrical cord retracting into said hollow interior portion to form said slack when said toilet seat body is pivoted in a closing direction, and a guide stopper affixed within said hollow interior portion and positioned within said loop for guiding said electrical cord during the extension and retraction thereof.

2. An apparatus for accommodating an electrical cord in a heated toilet seat according to claim 1, further including a fabric or tape member affixed to said heater for supporting the slack portion of said electrical cord on said heater.

3. An apparatus for accommodating an electrical cord in a heated toilet seat according to claim 2, wherein said grommet is secured in said hole in an upwardly slanted attitude.

4. An apparatus for accommodating an electrical cord in a heated toilet seat according to claim 1, wherein said toilet seat body is provided with an opening which faces the grommet provided in said base cover, and a slide bushing is disposed in said opening, said electrical cord passing through said slide bushing.

5. An apparatus for accommodating an electrical cord in a heated toilet seat which comprises a toilet seat body having a hollow interior portion and a heater, a base cover having control means for controlling the heater, and an electrical cord for electrically interconnecting the heater and the control means, said toilet seat body being connected to said base cover for pivoting through a predetermined angle, said apparatus including a grommet provided in a hole formed in said base cover, and a smooth slide plate affixed to said toilet seat body within the hollow interior portion thereof and having a guide stopper extending from said plate, one end of said electrical cord passing through said grommet and being tightly secured thereby, and the other end of said electrical cord being fixed within the hollow interior portion of said toilet seat body and having a 1*a* slack portion in the shape of a loop accommodated within said hollow interior portion on said slide plate, said electrical cord extending from said hollow interior portion to take up the slack when said toilet seat body is pivoted in an opening direction, said electrical cord retracting into said hollow interior portion to form said slack on said slide plate when said toilet seat body is pivoted in a closing direction, said guide stopper guiding said electrical cord during the extension and retraction thereof.

6. An apparatus for accommodating an electrical cord in a heated toilet seat according to claim 5, wherein said slide plate consists of an electrically insulative material.

7. An apparatus for accommodating an electrical cord in a heated toilet seat according to claim 5, wherein said guide stopper is integrally formed on said slide plate.

8. An apparatus for accommodating an electrical cord in a heated toilet seat according to claim 5, wherein said guide plate has a guide wall formed thereon which delimits the area within the hollow interior body for accommodating said electrical cord.

* * * * *